US010124932B2

(12) United States Patent
Martial

(10) Patent No.: US 10,124,932 B2
(45) Date of Patent: Nov. 13, 2018

(54) BAG COMPRISING A CLOSURE DEVICE FIXED TO EXTENSION WEBS

(71) Applicant: S2F FLEXICO, Henonville (FR)

(72) Inventor: Romain Martial, Lille Adam (FR)

(73) Assignee: S2F FLEXICO, Henonville (FR)

( * ) Notice: Subject to any disclaimer, the term of this patent is extended or adjusted under 35 U.S.C. 154(b) by 0 days.

(21) Appl. No.: 15/508,474

(22) PCT Filed: Sep. 4, 2015

(86) PCT No.: PCT/EP2015/070288
§ 371 (c)(1),
(2) Date: Mar. 2, 2017

(87) PCT Pub. No.: WO2016/034720
PCT Pub. Date: Mar. 10, 2016

(65) Prior Publication Data

US 2017/0275055 A1 Sep. 28, 2017

(30) Foreign Application Priority Data

Sep. 4, 2014 (FR) ..... 14 58288

(51) Int. Cl.
*B65D 33/16* (2006.01)
*B65D 33/00* (2006.01)
(Continued)

(52) U.S. Cl.
CPC ..... *B65D 33/007* (2013.01); *B65D 33/24* (2013.01); *B65D 33/2508* (2013.01); *B65D 33/2541* (2013.01); *B65D 2215/06* (2013.01)

(58) Field of Classification Search
CPC .. B65D 33/007; B65D 33/24; B65D 33/2541; B65D 33/2508
(Continued)

(56) References Cited

U.S. PATENT DOCUMENTS 4,285,376 A * 8/1981 Ausnit ..... B65D 33/2525 383/203
4,807,300 A * 2/1989 Ausnit ..... B65D 33/2533 156/66
(Continued)

FOREIGN PATENT DOCUMENTS

DE 1776769 U 10/1958
EP 1132311 A2 * 9/2001 ..... B65D 33/2591
WO WO-02074645 A2 9/2002

OTHER PUBLICATIONS

French Search Report with English language translation cover sheet, dated Apr. 27, 2015, French Application No. 1458288.
(Continued)

*Primary Examiner* — Jes F Pascua
(74) *Attorney, Agent, or Firm* — Womble Bond Dickinson (US) LLP

(57) ABSTRACT

The invention relates to a bag (1) comprising: —two walls (10, 20), —two support webs (12, 22), each comprising at least one complementary section (3), an upper edge (12*a*, 22*a*), —two extension webs (14, 24), each comprising an upper part (14*a*, 24*a*) fixed to a respective wall (10, 20) of the bag (1) close to the mouth (5), and a lower part (14*b*, 24*b*) that is movable with respect to said wall (10, 20), the support webs (12, 22) being fixed to a respective wall (10, 20) by way of a respective extension web (14, 24) away from their upper edge (12*a*, 22*a*), such that the traction on the walls (10, 20) of the bag (1) when the complementary sections (3) are in contact causes the support webs (12, 22) to rotate about said complementary sections (3).

23 Claims, 6 Drawing Sheets

(51) Int. Cl.
*B65D 33/24* (2006.01)
*B65D 33/25* (2006.01)

(58) Field of Classification Search
USPC ..... 383/63, 65
See application file for complete search history.

(56) References Cited

U.S. PATENT DOCUMENTS 4,878,763 A * 11/1989 Ausnit ..... B65D 33/2508 24/585.12
4,912,616 A * 3/1990 Van Erden ..... B65D 33/2508 383/65
5,272,794 A * 12/1993 Hamatani ..... A44B 19/16 24/586.1
RE34,554 E * 3/1994 Ausnit ..... B65D 33/2516 24/462
5,351,369 A * 10/1994 Swain ..... B65D 33/2541 24/304
6,257,763 B1 * 7/2001 Stolmeier ..... B65D 33/2591 383/5
7,048,442 B2 * 5/2006 Schneider ..... B65D 33/2525 383/203
9,011,003 B2 * 4/2015 Pawloski ..... B65D 33/2508 383/61.2
2010/0202714 A1 8/2010 Koenigkramer
2014/0161374 A1 * 6/2014 Septien Rojas .... B65D 33/2508 383/63
2016/0194117 A1 * 7/2016 Goto ..... B65D 33/2541 383/63

OTHER PUBLICATIONS

International Search Report with English language translation, dated Oct. 30, 2015, PCT Application No. PCT/EP2015/070288.

* cited by examiner

State of the Art

BAG COMPRISING A CLOSURE DEVICE FIXED TO EXTENSION WEBS

FIELD OF THE INVENTION

The present invention relates to the field of packaging bags.

More precisely, the present invention relates to the field of packaging bags comprising opening/closing means, for example and non-limiting in the form of complementary profiles.

TECHNOLOGICAL BACKGROUND

Many packaging bags and many closing devices for this purpose have already been proposed.

The majority of closing devices known for this purpose comprises two complementary profiles, for example of male/female type or of velvet/hook type, or again of complementary hook type, carried by respective support webs.

The appended FIG. 5 shows the mouth of a reclosable bag known from document FR 2 628 067.

FIG. 5 shows the two main walls 10, 20 of the bag at the mouth of the latter. The appended FIG. 5 also shows a closing device 100 comprising two complementary closing profiles 110, 120 carried by respective support webs 112, 122 fixed respectively on the walls 10 and 20.

More precisely, the fastening zones of the support webs 112, 122 on the walls 10 and 20 are referenced 114 and 124.

It is evident from FIG. 5 that the fastening zone 114 of the support web 112 on the wall 10 is not superposed on the male profile 110 but offset relative to the latter. Alternatively, the fastening zone 124 of the support web 122 on the wall 20 could be offset relative to the female profile 120. In this way, the web 112 forming a support to the male profile 110 is articulated on the wall 10 at the fastening zone 114. As is described in document FR 2 628 067, the foregoing arrangement avoids internal pressure to the bag from being applied to the closing profiles 110, 120 and tends to separate the latter. In fact, by way of the arrangement described above and as shown in FIG. 5, the separation of the walls 10, 20 of the bag (to open the latter) results in possible pivoting of the support web 110 at the hinge zone formed by its fastening, without risk of separation of the closing profiles 110, 120.

Bags responding to the arrangement shown in FIG. 5 have already provided major service and make reopening of the bag difficult, so as to ensure its user that its contents cannot be taken out easily.

Document FR 2 963 927 also proposes that the two zones 114, 124 are located at a distance from and on either side of the corresponding complementary profiles 110, 120 in such a way that one of the articulated webs 112 is directed towards the interior of the bag, whereas the other articulated web 122 is directed towards its mouth.

These bags also resist internal and external stresses of the walls of the bag, to such a point where today it proves very difficult to open it without damaging the closing device 100 or the walls of the bag.

But in some cases, it can prove necessary to be able to open the bag without damaging it to access its contents and be sure of reclosing it after opening.

Such a bag for example applies to the field of packaging harmful products, such as dishwasher tablets. In fact, it is important to be able to ensure users that the bag stays closed between two uses, especially to prevent children accessing its contents, and letting parents open and reclose the bag several times without risking damaging it, and preferably without successive openings and closings being too difficult.

U.S. Pat. No. 4,878,763 describes a structure of a reclosable bag comprising walls on which are fixed slide closing strips and configured to resist opening during application of a force to the mouth.

Document WO 02/074645 describes a reclosable bag comprising a gusset and a closing device. During opening of the bag, access to the contents of the bag is granted between the gusset and a wall opposite the bag.

SUMMARY OF THE INVENTION

An aim of the invention is therefore to propose a packaging bag which is capable of resisting the internal and external stresses of the walls of the bag, and enables easy opening and closing of its mouth by a user other than a child, especially to prevent access inside the bag to children while ensuring that the user can open and close the bag without risk of damaging it a number of times.

For this, the invention proposes a bag comprising:

two walls, joined together at three sides so as to form a bottom and a mouth, two support webs extending along a main direction defining a longitudinal axis, the support webs each comprising at least one complementary profile, an upper edge and a lower edge extending along the longitudinal axis, the upper edge being adjacent to the mouth and the lower edge being opposite the upper edge.

The bag further comprises two extension webs each comprising an upper part, fixed to a respective wall of the bag close to the mouth, and a lower part moveable relative to said wall, the support webs being fixed to a respective wall by means of a respective extension web, one at least of the support webs being fixed to the extension web at a distance from its upper edge in such a way that the traction on the walls of the bag when the complementary profiles are engaged causes rotation of the support webs about said complementary profiles.

Because of such a closing device, moved away from the mouth by extension webs which are fixed on one at least of the support webs at a distance from its upper edge, a stress in traction applied to the walls of the bag when the complementary profiles are engaged causes rotation of the support webs about said complementary profiles, and prevents opening of the bag.

Some preferred though non-limiting characteristics of the bag described hereinabove are the following:

the at least one support web is fixed to the corresponding extension web in a zone adjacent to the complementary profile carried by said support web, the extension webs are formed integrally with the corresponding walls, the extension webs extend in the extension of their corresponding wall and are obtained by folding back said wall on itself, the support webs are integrally formed with their corresponding extension web, the support webs are fixed on the extension webs by welding, the other support web is also fixed to the corresponding extension web at a distance from its upper edge, for example in a zone adjacent to the complementary profile carried by said support web, each closing assembly comprises at least two complementary profiles, preferably at least three, for example between three and six, all or some of the complementary profiles comprise sequential alterations formed transversally to the longitudinal axis, typically sequential crushings, a distance between the mouth and the complementary profiles is substantially comprised between 30 and 70 millimeters, preferably of the order of 40 millimeters, when the bag is at rest, the walls are opaque, the extension webs extend towards the bottom of the bag, a thickness of the walls and the extension webs is comprised between 30 micrometers and 200 micrometers, typically of the order of 60 micrometers to 150 micrometers, the support webs have a height, between the upper edge and the lower edge, comprised between 10 millimeters and 30 millimeters, preferably of the order of fifteen or twenty millimeters, each support web comprising between three and six complementary profiles, and the extension webs and/or the support webs are fixed to the sides of the bag, for example by welding.

BRIEF DESCRIPTION OF THE DRAWINGS

Other characteristics, aims and advantages of the present invention will emerge more clearly from the following detailed description and with respect to the appended drawings given by way of non-limiting examples, wherein.

DETAILED DESCRIPTION OF AN EMBODIMENT

Figure 1A:
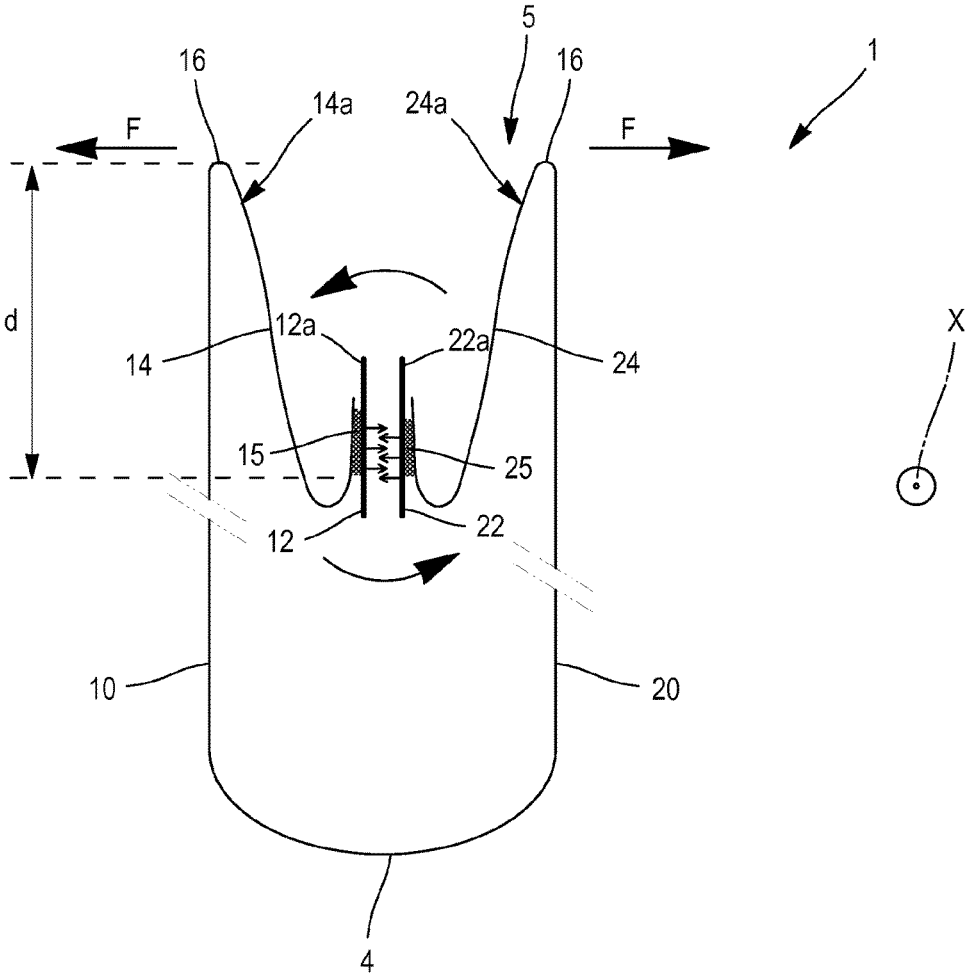
FIG. 1*a* illustrates a view in transversal cross-section of a first embodiment of a bag according to the invention, the bag being at rest.

Conventionally, a bag 1 comprises two walls 10, 20, joined together at three sides so as to form lateral sides, a bottom 4 and a mouth 5 of the bag 1.

The walls 10, 20 of the bag 1 can form the object of many embodiments.

These are preferably walls 10, 20 made of thermoplastic material.

These walls 10, 20 can be mono- or multilayer and mono- or multi-material. If needed, they can be a paper base covered in a layer of thermoplastic materials, or again a metallized thermoplastic layer.

The bag 1 can be made by means of a single sheet folded back on itself and welded on two sides, or several sheets, for example two sheets welded together at their sides, preferably according to ridges connecting the walls 10, 20 and forming the lateral sides and the bottom 4 of the bag 1.

The bag 1 further comprises a closing device 2 comprising two support webs 12, 22 extending according to a main direction defining a longitudinal axis X.

The support webs 12, 22 each comprise at least one complementary profile, an upper edge 12*a*, 22*a* and a lower edge 12*b*, 22*b* extending along the longitudinal axis X. The upper edge 12*a*, 22*a* of the support webs 12, 22 is adjacent to the mouth 5 and the lower edge 12*b*, 22*b* is opposite the upper edge 12*a*, 22*a* and extends in the direction of the bottom 4 of the bag 1.

Preferably, the support webs 12, 22 comprise several complementary profiles 3, for example between three and six complementary profiles 3. The presence of several profiles 3 in fact facilitates engaging the complementary profiles 3 from the external faces of the walls 10, 20 of the bag 1, by reducing the precision necessary to ensure their closing.

The complementary profiles 3 can be of male/female type, female/female (profiles in arrow form, as illustrated in the figures) or of velvet/hook type, or again of complementary hook type.

As illustrated in the figures, the bag 1 further comprises two extension webs 14, 24 each comprising an upper part 14*a*, 24*a* and a lower part 14*b*, 24*b*. The upper part 14*a*, 24*a* of each extension web 14, 24 is fixed to a corresponding wall of the bag 1 close to the mouth 5, while the lower part 14*b*, 24*b* of the extension web 14, 24 is moveable relative to this wall. Preferably, the extension webs 14, 24 extend overall towards the interior of the bag 1, or in the direction of the bottom 4 of the latter, in such a way that their lower part 14*b*, 24*b* is retracted relative to the mouth 5.

The extension webs 14, 24 can be formed integrally and in a single piece with the associated wall of the bag 1. Typically, the wall and the associated extension web 14, 24 can be formed in the same film which is folded back on itself along a fold 16 extending along the longitudinal axis X, in such a way that each extension web 14, 24 extends in the extension of the corresponding wall and towards the interior of the bag 1. The upper part 14*a*, 24*a* of the extension web 14, 24 corresponds to the portion of the film which extends towards the interior of the bag 1 and which is adjacent to the fold 16, whereas the lower part 14*b*, 24*b* of the extension web 14, 24 corresponds to the portion of the film which is adjacent to the end of said film inside the bag 1. In this embodiment, the mouth 5 of the bag 1 is therefore formed by a fold 16.

As a variant, the extension webs 14, 24 can be applied and fixed on the corresponding wall of the bag 1 by welding at a welding zone 15, 25, close to the mouth 5.

According to yet another variant, one of the extension webs 14, 24 can be formed integrally and in a single piece with one of the walls 10, 20 of the bag 1, whereas the other of the extension webs 14, 24 can be applied and fixed to the other of the walls 10, 20 by welding.

Each support web 12, 22 is also fixed to a respective wall of the bag 1 by means of a corresponding extension web 14, 24, given that one at least of the support webs 12, 22 is fixed to the corresponding extension web 14, 24 at a distance from its upper edge 12*a*, 22*a*, preferably the two support webs 12, 22.

Preferably, the closing device 2 extends inside the bag 1, at a distance from the mouth 5, so as not to be directly accessible or visible from the mouth 5. But this is not limiting, to the extent where the closing device 2 could also extend above the mouth 5.

In the examples illustrated in the figures, the two support webs 12, 22 are fixed to the corresponding extension web 14, 24 at a distance from their upper edge 12*a*, 22*a*, on the face of the support webs 12, 22 which is opposite the face bearing the complementary profiles 3.

In one embodiment, fastening the extension web 14, 24 to the support web 12, 22 is done in a zone adjacent to the complementary profiles 3.

As a variant, fastening the extension web 14, 24 to the support web 12, 22 can be done between the complementary profiles 3 and the lower edge 12*b*, 22*b* of the support web 12, 22.

This configuration produces a bag 1 comprising a closing device 2 capable of resisting internal stresses (due to the bulk of the contents of the bag 1) and external stresses (due to the action of the user on the mouth 5, etc.) of the walls 10, 20 of the bag 1, and enables easy opening and closing of its mouth 5 by a user other than a child. In fact, when the complementary profiles 3 are engaged, stress in traction of the walls 10, 20 of the bag 1 (perpendicularly to the walls 10, 20 of the bag 1, according to arrows F of FIGS. 1*a* and 1*b*) causes tension of the extension webs 14, 24 and rotation of the closing device 2 about the complementary profiles 3 until overall the support webs 12, 22 and the extension webs 14, 24 align with the direction of application of the traction force F. This alignment, seen in FIG. 1*b*, makes opening the bag 1 particularly difficult, even by an adult. To open the bag 1, the support webs 12, 22 have to be gripped directly and their upper edges 12*a*, 22*a* moved apart, the effect of which is to apply a force perpendicular to the support webs 12, 22 to the complementary profiles 3 and separate them. This opening is done easily, without excessive force for the adult.

This gripping of the support webs 12, 22 is not evident for children who naturally tend to grip the bag 1 by its walls 10, 20. But opening the bag 1 by stressing the walls 10, 20 is particularly difficult due to rotation of the support webs 12, 22: only considerable force on the walls 10, 20 of the bag 1 would likely open it. Yet such force is too intense for a child who could not therefore access the contents of the bag 1.

Also, the presence of extension webs 14, 24 and fastening of the closing device 2 at a distance from the upper edge 12*a*, 22*a* of the support webs 12, 22 offsets the closing device 2 towards the interior of the bag 1 rather than at its mouth 5, which further reinforces the tendency of children to grip the walls 10, 20 of the bag 1 rather than the support webs 12, 22, and reduces the risk of a child seeing the closing device 2 when the bag 1 is placed on a support.

This tendency can be further improved by employing sufficiently long extension webs 14, 24 so that the complementary profiles 3 extend at a distance d of the order of the length of the adult thumb from the mouth 5 (when the bag 1 is at rest), or a distance between 30 and 70 millimeters, typically of the order of fourteen millimeters for a bag of a width of twenty centimeters. An adult will have no difficulty in opening the bag 1, directly gripping the support webs 12, 22 and separating them, whereas the risk of a child envisaging opening the bag 1 by gripping the support webs 12, 22 is reduced, given the distance between these support webs 12, 22 and the mouth 5 of the bag 1, the effect of which is that the child in all cases will have difficulties in reaching these support webs 12, 22, as its hands are too small. The child will therefore rather tend to grip the extension webs 14*a* and 24*a*, which will not open the bag 1.

In an embodiment, the support webs 12, 22 have a height (dimension in a direction transversal to the longitudinal axis X, i.e., between the upper edge 12*a*, 22*a* and the lower edge 12*b*, 22*b*) relatively low by comparison with usual support webs, so as to limit the gripping zones likely to be gripped, and makes opening of the closing device 2 by children more difficult.

Typically, the support webs 12, 22 can have a height between 10 millimeters and 30 millimeters. For example, the height of the support webs 12, 22 can be of the order of fifteen or twenty millimeters.

If appropriate, when the extension web 14, 24 is fixed by welding to the support web 12, 22 at the complementary profiles 3, the height of the support webs 12, 22 can be reduced by eliminating the zone of the support web 12, 22 extending under the complementary profiles 3.

The walls 10, 20 of the bag 1 can further be made from opaque material (non-transparent), so as to reduce the possibility for children of seeing the closing device 2 through the walls 10, 20.

By way of advantage, the embodiment of the extension webs 14, 24 lets them play the role of a gusset, widening the mouth 5 of the bag 1 when the latter is closed. The bag 1 can therefore be placed upside down on a support, i.e., on its mouth 5, which not only produces a bag 1 which can be placed stably on the support but also hides opening of the bag 1 from children, where they see neither the mouth 5 nor the closing device 2.

Fastening a support web 12, 22 to an extension web 14, 24 can be done by any means.

Figure 3:
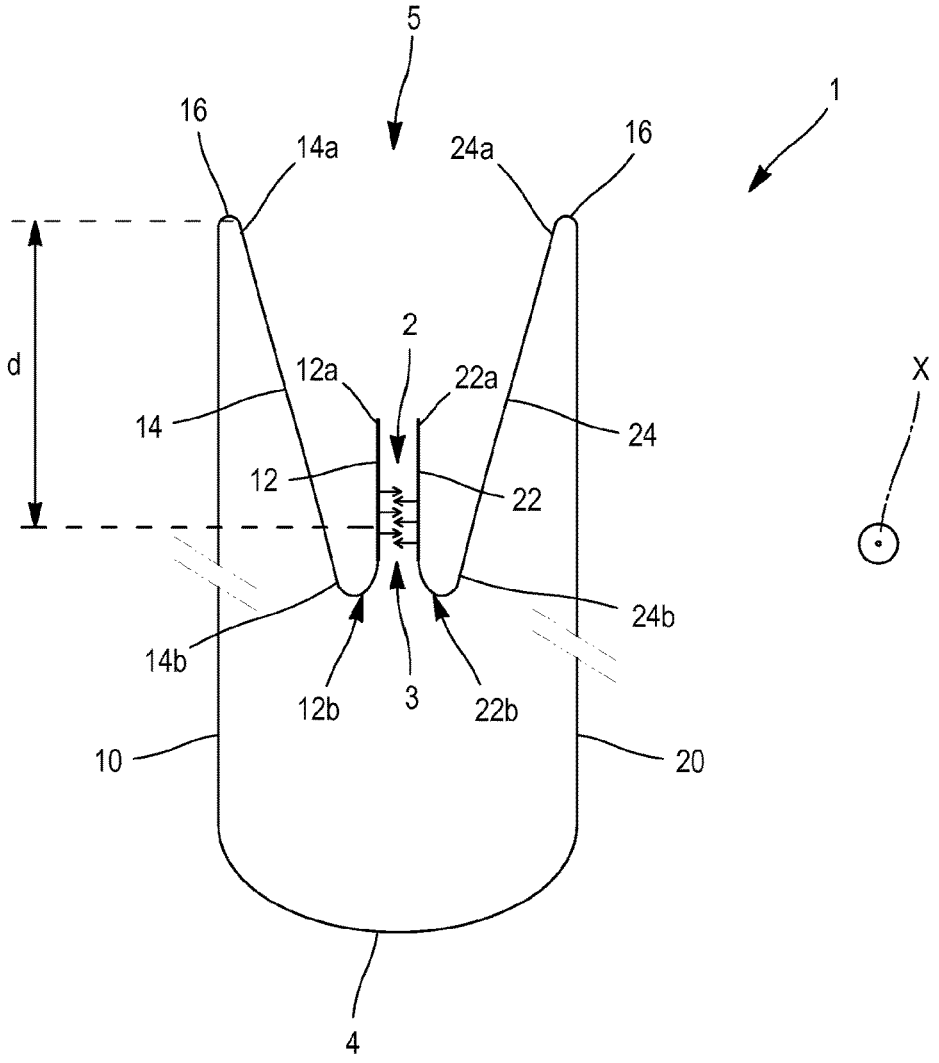
FIG. 3 illustrates a view in transversal cross-section of a third embodiment of a bag according to the invention, the bag being at rest.

In a first embodiment illustrated in FIG. 3, the support web is formed integrally and in a single piece with the extension web 14, 24. Typically, the extension web 14, 24 and the associated support web can be formed in the same film which is folded back on itself along a fold 16 extending along the longitudinal axis X, inside the bag 1. The support web 12, 22 extends therefore in the extension of the extension web 14, 24, between the resulting fold 16 and the mouth 5. In this embodiment, the lower edge 12*b*, 22*b* of the support web 12, 22 is therefore formed by this fold 16 of the film.

In FIG. 3, the two support webs 12, 22 are formed integrally with their corresponding extension web 14, 24.

Figure 1B:
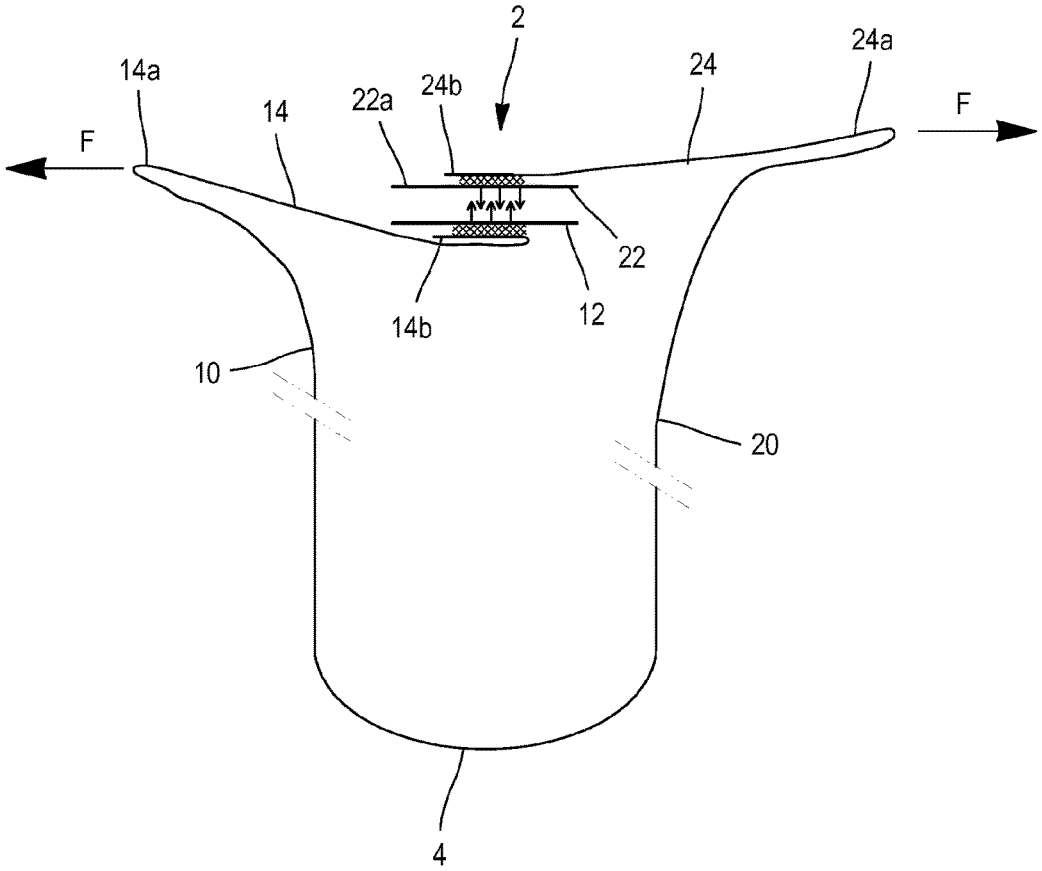
FIG. 1*b* illustrates the bag of the FIG. 1*a*, while a traction force is applied to the walls to open them.
Figure 2:
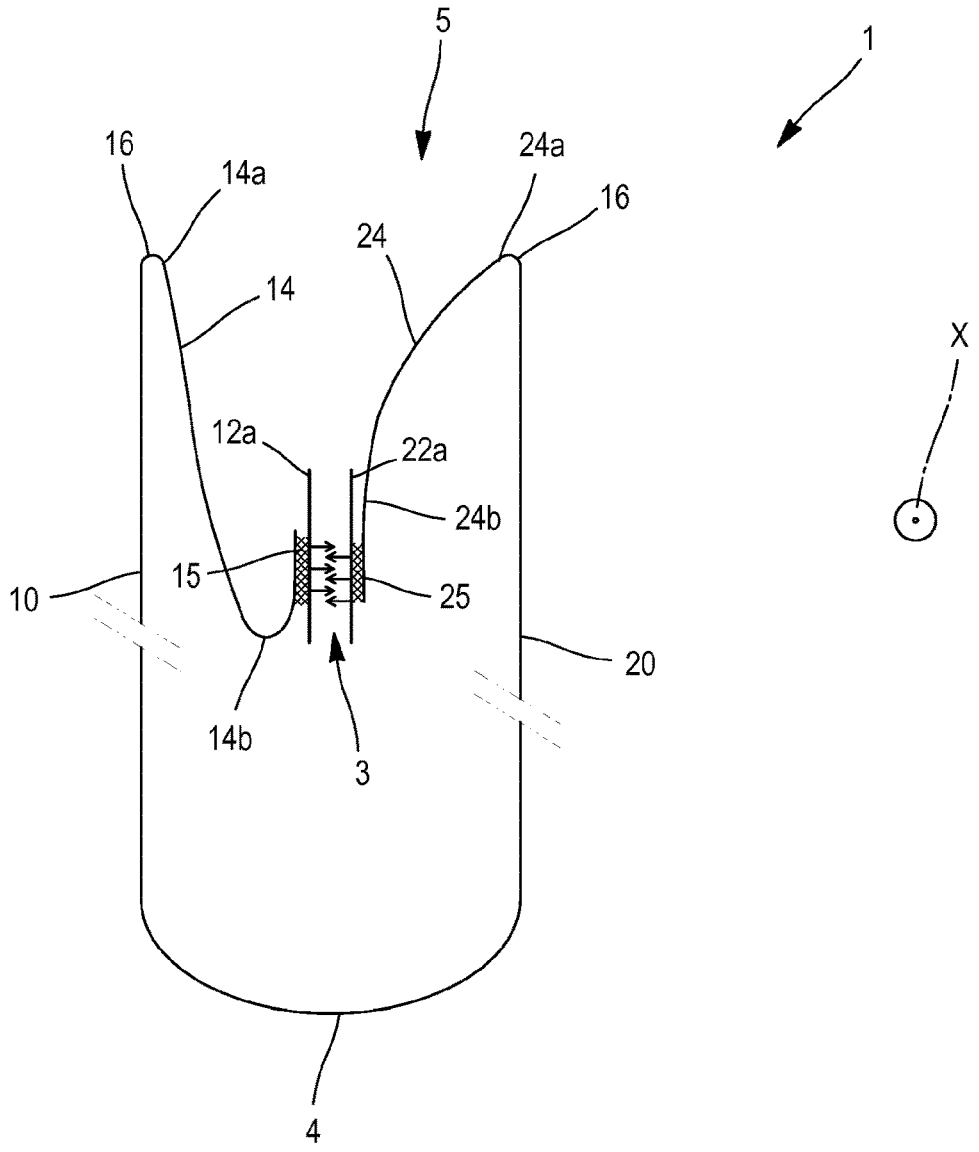
FIG. 2 illustrates a view in transversal cross-section of a second embodiment of a bag according to the invention, the bag being at rest.
Figure 4:
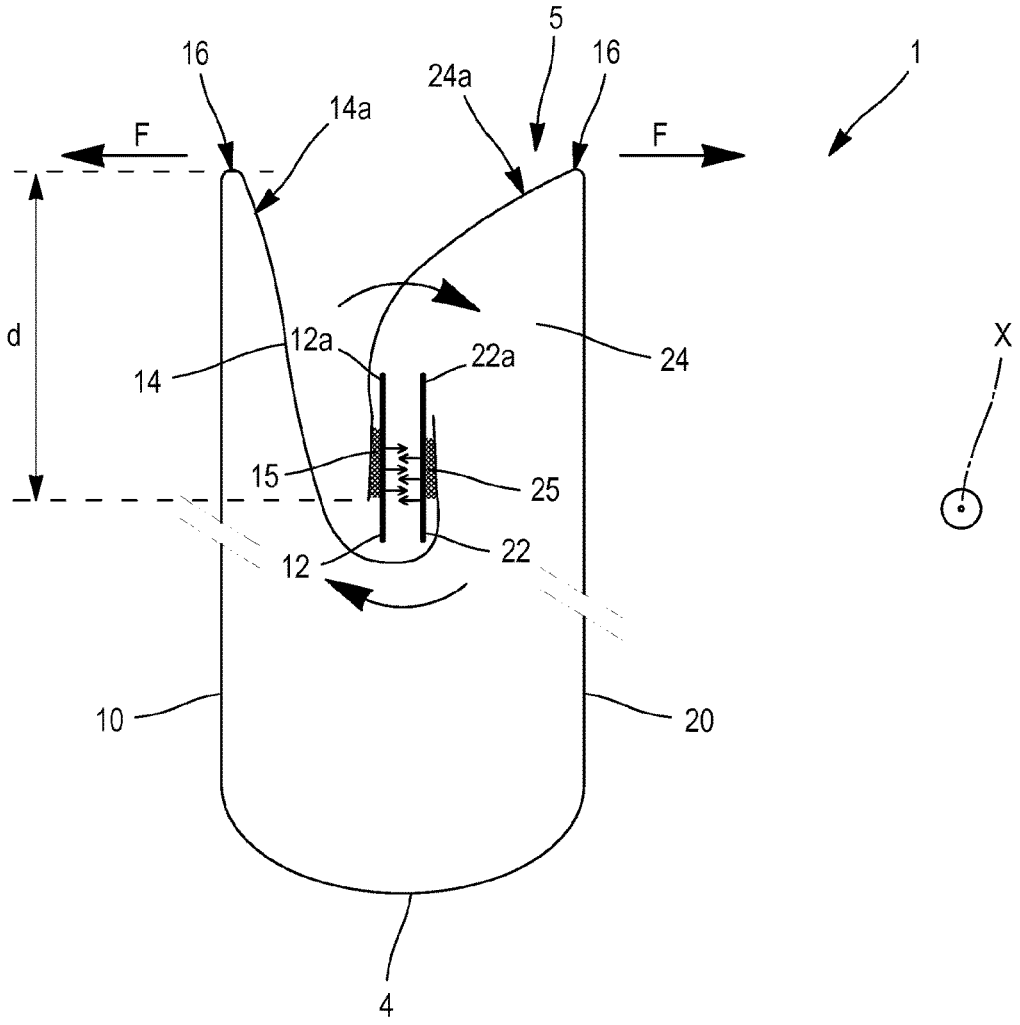
FIG. 4 illustrates a view in transversal cross-section of a fourth embodiment of a bag according to the invention, the bag being at rest, FIG. 5 described earlier schematically illustrates the mouth of a bag according the prior art.
Figure 5:
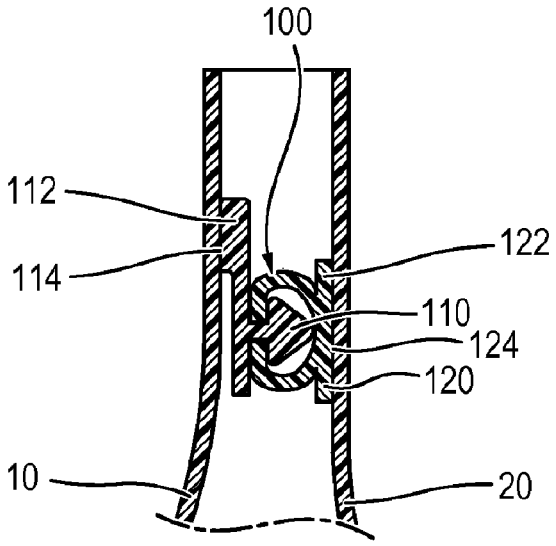

In a second embodiment illustrated in FIGS. 1*a*, 2 and 4, the support web 12, 22 is applied and fixed to the corresponding extension web 14, 24.

In this embodiment, the lower part 14*b*, 24*b* of the extension web 14, 24 can be folded back on itself along a second fold which extends along the longitudinal axis X. The free end of the extension web 14, 24 extends therefore in the direction of the mouth 5 of the bag 1. The face of the extension web 14, 24 on which the support web 12, 22 is fixed corresponds to the internal face of the extension web 14, 24, i.e., the face which extends towards the interior of the bag 1.

Alternatively, one at least of the extension webs 24 can be fixed directly on the support web 22 (see FIG. 2), without forming a second fold. The face of the extension web 24 on which the support web 22 is fixed then corresponds to the external face of the extension web 24, i.e., the face opposite the internal face.

As per yet another alternative, one of the extension webs 24 can be fixed directly on the support web 12, without forming a second fold, while the other of the extension webs 14 is folded back on itself so as to form a second fold (see FIG. 4) and fixed to the support web 22. The support web 12 is fixed on the internal face of the extension web 24, whereas the support web 22 is fixed on the external face of the extension web 14. Such an alternative makes separation of the complementary profiles 3 even more difficult.

Irrespective of the embodiment, the extension webs 14, 24 and/or the support webs 12, 22 can be fixed to the lateral sides of the bag 1, for example by welding. This fastening to the lateral sides of the bag 1 keeps the closing device 2 inside the bag 1 at all times, avoiding the risk of a child taking out the closing device 2 and more easily being able to open the bag 1.

But this is not limiting, as the extension webs 14, 24 and the support webs 12, 22 cannot be fixed to the lateral sides of the bag 1.

The complementary profiles 3 can be altered sequentially according to an alteration in a direction transversal to the support webs 12, 22. The sequential alterations are local sequential modifications of the complementary profiles 3, can especially comprise sequential crushings and/or sequential incisions without removal of material (i.e., either only sequential crushings or only sequential incisions, or both sequential crushings and sequential incisions). Reference could be made especially to international application EP2012/073186 in the name of the applicant, which describes embodiments of sequential alterations.

In this embodiment, all or some of the complementary profiles 3 can comprise the sequential alterations. So, several complementary profiles 3 can comprise sequential alterations while at least one complementary profile can remain intact, or vice versa.

The bag 1 can further comprise evidence of opening, letting a user verify that a third party has not previously opened the bag 1. Such evidence of opening can especially be formed by extending the walls 10, 20 of the bag 1 (the two support webs 12, 22, respectively) so as to join them together. The evidence of opening can be external and extend above the complementary profiles 3, or internal and extend into the bag 1, between the complementary profiles 3 and the bottom 4 of the bag 1.

For example and as is known per se, the two walls 10, 20 of the bag 1 (the two support webs 12, 22, respectively) can be formed integrally and in a single piece. To open the bag 1, this common web must be broken to separate it into two distinct walls 10, 20 (two distinct support webs 12, 22, respectively). If needed, the web can comprise a line of weakness, made by local thinning or pre-cutting of the web.

As a variant, the two walls 10, 20 (the two support webs 12, 22, respectively) can be connected by means of a peelable multilayer.

The walls 10, 20, the extension webs 14, 24, the support webs 12, 22 and the complementary profiles 3 can be made of a single material only, especially one of the following materials: polypropylene PP, poly(ethylene terephthalate) PET, polyethylene PE, high-density polyethylene HDPE, low-density polyethylene LDPE and their associated copolymers, ethylene copolymers and/or propylene copolymers.

As a variant, these different elements of the bag 1 can be made of different materials. Particular, but non-limiting, example are a bag 1 comprising walls 10, 20 and extension webs 14, 24 made of poly(ethylene terephthalate) and/or polyethylene and a closing device 2 made of polypropylene.

Also, the walls 10, 20 and the extension webs can have a thickness comprised between 30 micrometers and 200 micrometers, typically of the order of 60 micrometers to 150 micrometers, especially when said walls are formed from one of the materials described above. It is clear of course that the walls 10, 20 and the extension webs 14, 24 can be made of complex materials comprising several layers of different materials.

The invention claimed is:

1. A bag comprising:

a first wall and a second wall, joined together at three sides so as to form a bottom and a mouth, a first and a second support webs extending along a main direction defining a longitudinal axis, the first and second support webs each comprising at least one complementary profile, an upper edge and a lower edge extending along the longitudinal axis, the upper edge being adjacent to the mouth and the lower edge being opposite the upper edge, a first extension web comprising an upper part, fixed to the first wall of the bag close to the mouth, a lower part moveable relative to said first wall, a second extension web comprising an upper part, fixed to the second wall of the bag close to the mouth, and a lower part moveable relative to said second wall, wherein the first support web and the second support web are fixed to a the first wall and the second wall by means of the first extension web and the second extension web, respectively, such that, when the bag is at rest:

the first extension web extends between the lower edge of the first and second support webs and the bottom of the bag, the second extension web extends between the upper edge of the first and second support webs and the mouth of the bag, such that traction on the walls of the bag when the complementary profiles are engaged causes rotation of the support webs about said complementary profiles.

2. The bag according to claim 1, wherein the first and second extension webs are formed integrally with the corresponding walls.

3. The bag according to claim 2, wherein the first and second extension webs extend in the extension of their corresponding wall and are obtained by folding back said wall on itself.

4. The bag according to claim 1, wherein the first extension web is directly fixed to the first support web, without forming a fold between the upper edge and the lower edge of the first extension web, and the second extension web is fixed to the second support web, a fold being formed between the upper part and the lower part of the second extension web.

5. The bag according to claim 1, wherein the first and second extension webs comprise an inner face and an outer face, the inner face of the first and second extension webs being in the extension of an inner face of the first and second walls, respectively, and the first support web being fixed to the inner face of the first extension web while the second support web being is to the inner face of the second extension web.

6. A bag comprising:

a first and a second walls, joined together at three sides so as to form a bottom and a mouth, a first and a second support webs extending along a main direction defining a longitudinal axis, the first and second support webs each comprising at least one complementary profile, an upper edge and a lower edge extending along the longitudinal axis, the upper edge being adjacent to the mouth and the lower edge being opposite the upper edge, a first extension web comprising an upper part, fixed to the first wall of the bag close to the mouth, a lower part moveable relative to said first wall, a second extension web comprising an upper part, fixed to the second wall of the bag close to the mouth, and a lower part moveable relative to said second wall, wherein the first support web and the second support web are fixed to a the first wall and the second wall by means of the first extension web and the second extension web, respectively, in such a way that the traction on the first and second walls of the bag when the complementary profiles are engaged causes rotation of the first and second support webs about said complementary profiles, wherein the second extension web is directly fixed to the second support web, without forming a fold between the upper edge and the lower edge of the said second extension web, so that the lower part of the second extension web extends towards the bottom of the bag when the bag is at rest, and wherein a fold is formed between the upper part and the lower part of the first extension web so that the lower part of the first extension web extends towards the mouth of the bag when the bag is at rest.

7. The bag according to claim 6, wherein the first and second extension webs comprise an inner face and an outer face, the inner face of the first and second extension webs being in the extension of an inner face of the first and second walls, respectively, and the outer face of the first and second extension webs being in the extension of an outer face of the first and second walls, respectively, the second support web being fixed to the outer face of the second extension web and the first support web being fixed to the inner face of the first extension web.

8. The bag according to claim 1 or 6, wherein the at least one of the first and second support webs is fixed to the corresponding extension web in a zone adjacent to the complementary profile carried by said support web.

9. The bag according to claim 1 or 6, wherein the first and second support webs are integrally formed with their corresponding extension web.

10. The bag according to claim 1 or 6, wherein the first and second support webs are fixed on the corresponding first and second extension webs by welding.

11. The bag according to claim 1 or 6, wherein the first and second support webs are fixed to the corresponding first and second extension web in a zone adjacent to the complementary profile carried by said first and second support webs.

12. The bag according to claim 1 or 6, wherein the first and second support webs comprises at least two complementary profiles.

13. The bag according to claim 1 or 6, wherein at the least one complementary profiles comprises sequential alterations formed transversally to the longitudinal axis.

14. The bag according to claim 1 or 6, wherein a distance between the mouth and the complementary profiles is substantially comprised between 30 and 70 millimeters the bag is at rest.

15. The bag according to one of claim 1 or 6, wherein the walls are opaque.

16. The bag according to claim 1 or 6, wherein a thickness of the walls and the extension webs is comprised between 30 micrometers and 200 micrometers.

17. The bag according to claim 1 or 6, wherein the first and second support webs have a height, between the upper edge and the lower edge, comprised between 10 millimeters and 30 millimeters, the first and second support webs each comprising between three and six complementary profiles.

18. The bag according to claim 1 or 6, wherein the first and second extension webs and/or the first and second support webs are fixed to the sides of the bag.

19. The bag according to claim 1 or 6, wherein the first and second support webs each comprise at least three complementary profiles.

20. The bag according to claim 1 or 6, wherein the first and second support webs each comprise between three and six complementary profiles.

21. The bag according to claim 1 or 6, wherein a distance between the mouth and the complementary profiles is of the order of 40 millimeters when the bag is at rest.

22. The bag according to claim 1 or 6, wherein a thickness of the walls and the first and second extension webs is of the order of 60 micrometers to 150 micrometers.

23. The bag according to claim 1 or 6, wherein first and second support webs have a height, between the upper edge and the lower edge, of the order of fifteen or twenty millimeters.

* * * * *